United States Patent [19]

Schulze

[11] Patent Number: 4,480,967

[45] Date of Patent: Nov. 6, 1984

[54] MOTOR-DRIVEN PUMP UNIT FOR A HIGH-PRESSURE CLEANING APPARATUS

[75] Inventor: Werner Schulze, Winnenden Hofen, Fed. Rep. of Germany

[73] Assignee: Alfred Karcher GmbH & Co., Winnenden, Fed. Rep. of Germany

[21] Appl. No.: 368,231

[22] Filed: Apr. 14, 1982

[30] Foreign Application Priority Data

Apr. 18, 1981 [DE] Fed. Rep. of Germany ..... 3115698

[51] Int. Cl.[3] ..... F04B 39/06

[52] U.S. Cl. ..... 417/368; 417/370; 417/371

[58] Field of Search ..... 417/357, 366, 367, 368, 417/369, 371, 370

[56] References Cited

U.S. PATENT DOCUMENTS

| | | | |
|---|---|---|---|
| 1,269,909 | 6/1918 | Cooper | 417/366 X |
| 2,160,278 | 5/1939 | Ness et al. | 417/371 |
| 2,454,371 | 11/1948 | Berges | 417/366 V |
| 2,763,214 | 9/1956 | White | 417/357 |
| 2,913,988 | 11/1959 | White | 417/368 X |
| 3,060,335 | 10/1962 | Greenwald | 417/368 X |
| 3,525,001 | 8/1970 | Erickson | 417/371 X |
| 3,644,067 | 2/1972 | Yowell | 417/370 |

FOREIGN PATENT DOCUMENTS

| | | | |
|---|---|---|---|
| 1828607 | 3/1961 | Fed. Rep. of Germany . | |
| 2216527 | 10/1973 | Fed. Rep. of Germany . | |
| 7920974 | 1/1980 | Fed. Rep. of Germany . | |
| 547957 | 4/1974 | Switzerland . | |
| 565271 | 11/1944 | United Kingdom | 417/368 |

*Primary Examiner*—Leonard E. Smith

*Attorney, Agent, or Firm*—Stephenson and Boller

[57] ABSTRACT

In a motor-driven pump unit for a high-pressure cleaning apparatus, where the cleaning fluid supplied by the high-pressure pump is conveyed through the housing of the motor so as to cool the motor, in order to improve the cooling characteristics and in order to reduce the dimensions of the motor-driven pump unit it is proposed that a fan wheel, which is driven by the motor and which directs a cooling air stream towards the motor housing, be disposed at the end of the motor opposite the pump, and that the fan wheel and the cooling surfaces of the motor be designed in such a way that an adequate cooling of the motor is achieved by the air stream cooling alone when the pump is not conveying any cleaning fluid to the cleaning apparatus or, in other words, is pumping the cleaning fluid only in circulation.

6 Claims, 3 Drawing Figures

MOTOR-DRIVEN PUMP UNIT FOR A HIGH-PRESSURE CLEANING APPARATUS

The invention relates to a motor-driven pump unit for a high-pressure cleaning apparatus, in which the cleaning fluid supplied by the high-pressure pump is conveyed through the housing of the motor in order to cool the motor.

In motor-driven pump units of this type, it is desirable to keep their size to a minimum. However, difficulties arise, in particular, as a result of the necessity of cooling the motor of the motor-driven pump unit in an efficient and reliable manner.

For this purpose it is known, for example, to fill the motor housing with oil (German Utility Model No. 79 20 974). On account of this oil charge, which is forcibly circulated through special devices and in addition to the heat-producing motor parts (rotor, stator and bearing) also comes into contact with the pump components in contact with the supplied cleaning fluid, the heat of the motor is transferred to the cleaning fluid. This solution has the disadvantage, however, that heat removal is only possible when cleaning fluid is continuously supplied and discharged. On the other hand, when the cleaning fluid stops the cooling ceases.

It is also not possible to ensure sufficient cooling when the cleaning medium supplied by the pump is not continuously discharged but, in the case of a closed spray-valve for example, is conveyed in circulation. The cleaning fluid cannot then give off the heat absorbed from the motor, so that the danger of the motor overheating also arises here.

In addition, it has already been proposed to convey the cleaning fluid through the wall of the motor before entering the high-pressure pump or immediately after leaving the high-pressure pump, in order to attain effective cooling, in particular in the region of the stator. The same problems, however, arise in this case.

This may only be remedied in the case of these devices by additional monitoring means being provided for monitoring the motor temperature, which cause the motor-driven pump unit to be switched off when a certain temperature threshold is exceeded. Such control means, however, are complicated and require, in particular, corresponding switching means. In the case of simple, robust high-pressure cleaning devices, however, it is desirable to avoid electrical control means of this type since they are complicated and can possibly lead to failure.

It is also known already to cool the motors of high-pressure-cleaning motor-driven pump units by an air stream which is preferably deflected past the outside of the motor housing. Such a design, however, necessitates large heat-exchange surfaces so that air cooling of this type is only possible in the case of motor-driven pump units which are extensive in terms of space. On the other hand, air cooling cannot be succeessfully employed in the case of structurally small and compact motor-driven pump units.

According to the invention, there is provided a motor-driven pump unit for a high-pressure cleaning apparatus, comprising a motor, a high-pressure pump for supplying cleaning fluid, a motor housing through which cleaning fluid is conveyed in order to cool the motor, and a fan wheel, which is arranged to be driven by the motor and to direct a cooling air stream towards the motor housing, and which is disposed at an end of the motor opposite the pump, the fan wheel and cooling surfaces of the motor being arranged such that adequate cooling of the motor is achieved by the air stream cooling alone when the pump is not conveying any cleaning fluid to the cleaning apparatus or in other words, is pumping the cleaning fluid only in circulation.

It is thus possible to provide a motor-driven pump unit for a high-pressure cleaning apparatus such that adequate cooling is ensured in all operating conditions, without additional temperature monitoring means being necessary. It is further possible to control the temperature conditions of the motor-driven pump unit, in particular in the case of motor-driven pump units of very compact design.

In addition to the cooling of the motor by the supplied cleaning fluid, an air cooling is supplied, the cooling air stream being produced by a fan wheel driven by the motor itself.

By virtue of the dimensioning provided according to the invention it is possible for the motor to be extremely effectively cooled while working, i.e. when the cleaning fluid is being supplied to a manual spray gun, essentially by the cleaning fluid flowing through the housing wall of the motor.

In other conditions of operation, i.e. for example when the cleaning fluid is stopped or when the manual spray gun is closed and the cleaning fluid is conveyed in circulation, cooling is effected by the cooling air stream produced by the fan wheel. Since, in this mode of operation, the conveying action effected by the motor either does not take place at all or only takes place with very slight flow resistance in circulation, the heat due to energy losses in this mode of operation is slight, so that the air cooling is quite sufficient to cool the motor in the desired manner practically without support from the fluid cooling. If, on the other hand, the conveying action is started and thus the power loss of the motor increases, the fluid cooling becomes effective in addition to the air cooling and then removes the greater part of the heat produced.

Preferably the cleaning fluid is conveyed through the motor housing only in the part thereof remote from the fan wheel. The part of the motor housing towards the fan wheel may be effectively cooled by the cooling air stream even when the motor is conveying cleaning fluid at full capacity.

In a preferred embodiment of the invention a duct, which surrounds the stator of the motor in a helical manner and is preferably formed by a steel tube embedded in the wall of the motor housing, is provided in the wall of the said housing in order to convey the cleaning fluid through the motor housing. In this case, the wall of the housing is preferably formed as an aluminum die-casting.

An improved transfer of the heat produced in the motor to the cooling air stream and/or the cleaning fluid flowing through the wall of the housing may be obtained by filling the interior of the motor with oil.

The invention will be further described, by way of example, with reference to the accompanying drawings, in which.

Figures 1, 2:
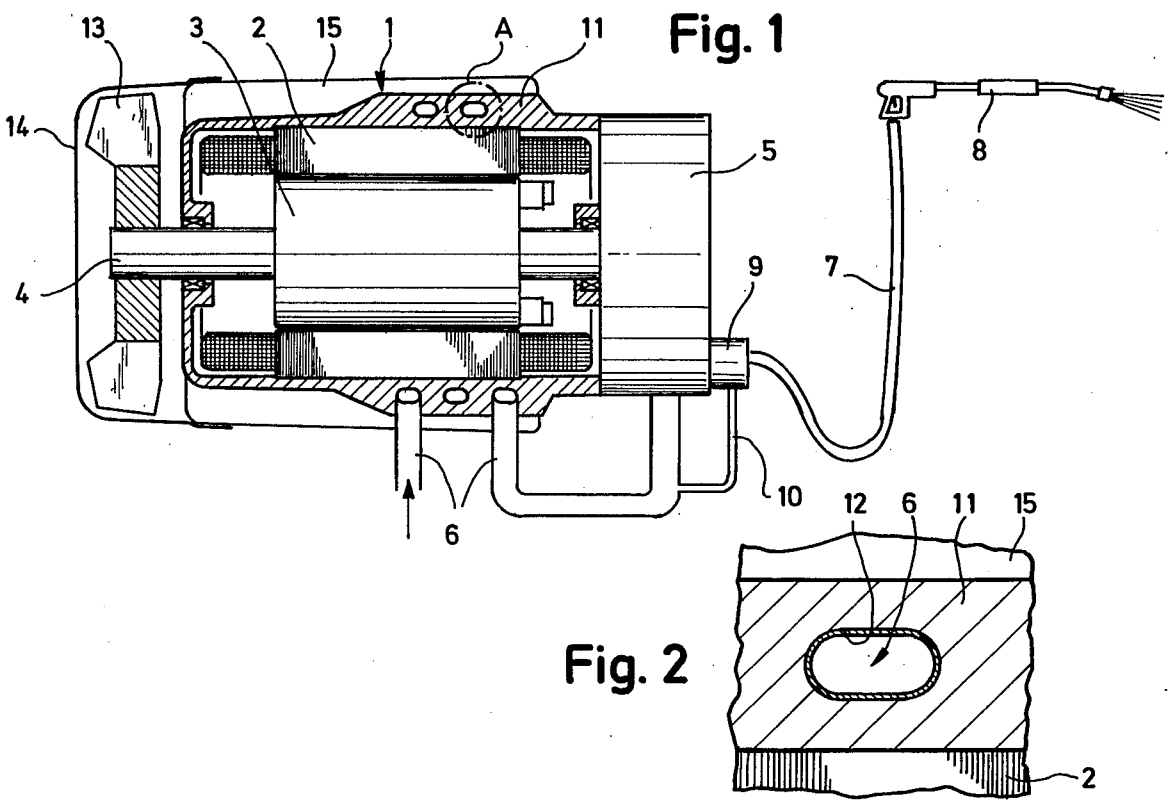
FIG. 1 is a diagrammatic longitudinal cross-section through a motor-driven pump unit constituting a preferred embodiment of the invention in a high-pressure cleaning apparatus.
FIG. 2 is an enlarged partial view corresponding to the cutaway portion A in FIG. 1.

The motor-driven pump unit illustrated in FIG. 1 comprises a cylindrical motor housing 1 in which a cylindrical stator 2 is disposed. A rotor 3 is mounted inside the housing in a manner known per se so as to be rotatable coaxially to the stator by means of a motor shaft 4. At one end of the motor housing the motor shaft 4 enters a pump housing 5 in which is disposed a high-pressure pump of design known per se and not illustrated in the drawing. This high-pressure pump draws in cleaning fluid, in particular water, by way of a suction pipe 6 and conveys the said cleaning fluid to a hand-held spray gun 8 by way of a flexible high-pressure line 7. A bypass pipe 10, which leads back to the suction pipe 6, branches off from the high-pressure line 7 before reaching the spray gun 8. An overflow valve 9 only shown diagrammatically in the drawing is connected to the bypass pipe 10. Using appropriate measures, for example direct control or pressure-dependent control, the quantity of the cleaning fluid discharged by the spray gun 8 is varied by measured closing of the overflow valve 9. The excess fluid is fed back to the suction pipe via the bypass pipe.

In the embodiment illustrated in FIG. 1 the suction pipe 6 is led around the stator 2 in a helical manner in the thickened wall 11 of the motor housing 1 before entering the pump housing 5, so that before entering the pump the supplied fluid flows through the wall 11 and cools it.

In this arrangement, in the embodiment illustrated, the flow path of the cleaning fluid inside the wall 11 is formed by a steel tube 12 which preferably has an oval cross-section. This helical steel tube 12 is embedded in the wall 11 which is preferably formed as an aluminium die-casting (FIG. 2). This ensures that the cleaning fluid, which in some cases is corrosive, does not damage the wall of the housing during operation, since the said fluid comes into contact only with the wall of the steel tube which is considerably more resistant to the cleaning fluid which in some cases contains corrosive chemicals.

In the embodiment illustrated, windings for the cleaning fluid are arranged only in the area of the motor housing adjacent the pump end of the motor. At the opposite end of the motor housing the wall is made less thick. In this area none of the ducts surrounding the stator for the cleaning fluid are arranged inside the wall.

At the end opposite the pump, the motor shaft 4 projects from the motor housing 1 and bears a fan wheel 13 in this area. The said fan wheel 13 is covered by a fan cap 14 which is secured to the motor housing 1. The fan wheel produces an air flow which passes along the outside of the motor housing in the longitudinal direction thereof and causes a cooling of the said motor housing. In order to increase the contact surface between the air stream and the motor housing, the motor housing has cooling ribs 15 projecting radially outwards.

When the motor-driven pump unit is in operation, a cooling air stream is always produced by the fan wheel and thus causes a certain cooling of the motor. When the manual spray gun is open and and the overflow valve is closed, the supplied cleaning fluid flows through the windings inside the wall of the motor housing before entering the high-pressure pump and thus cools the motor housing and, in particular, the adjacent stator, in which the greater part of the heat of the motor due to energy losses is produced. This heat is then discharged via the manual spray gun.

A very effective cooling of the motor-driven pump unit is achieved by the combined air-water cooling.

If the cleaning fluid ceases to be conveyed, for example when the cleaning fluid supply is interrupted, the cooling of the motor by the cleaning fluid stops. In this case, the entire cooling of the motor is performed solely by the cooling air stream case since, when the fluid is not being conveyed, the heat of the motor due to energy losses is substantially less than in the case of normal operation.

Similarly the cooling action of the cleaning fluid decreases when part or the whole of the cleaning fluid is conveyed in circulation via the bypass valve. Since the high-pressure pump need only produce a slight output in this mode of operation, in this case too the heat of the motor due to energy losses is slight so that the air cooling by the fan wheel is sufficient.

It is thus possible, by the combination of air cooling and fluid cooling, to obtain optimum cooling of the motor in all operation conditions, without safety measures having to be provided for the possibility of insufficient fluid cooling. In this way the design of the motor-driven pump unit as a whole is substantially simplified. In addition, it is possible, by virtue of the combination of air cooling and fluid cooling, to make the air cooling less than when air cooling alone is used. This results in a considerably more compact design of the motor-driven pump unit as a whole.

Figure 3:
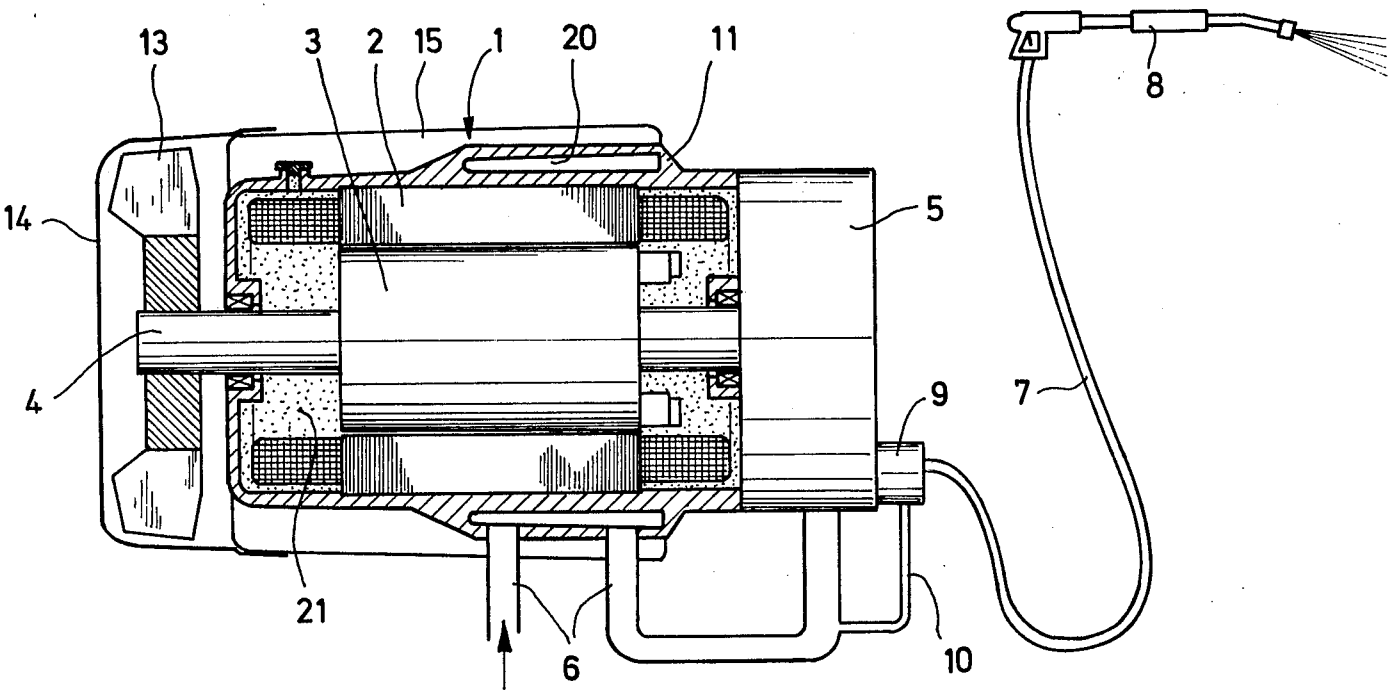
FIG. 3 is a view similar to FIG. 1 of a modified motor-driven pump unit constituting another preferred embodiment of the invention.

The embodiment illustrated in FIG. 3 is similar to that of FIG. 1, and the same parts therefore have the same reference numerals.

In contrast to the embodiment of FIG. 1, in this case the cleaning fluid flows through the wall of the motor housing, not in a helical duct, but in an annular gap 20, which extends inside the wall over part of the length of the motor housing.

In addition, in this embodiment the interior of the motor housing 1 is filled with an oil 21, which transfers the heat produced in the rotor and the stator and in the bearing shafts to the wall of the motor housing 1, from where it is removed by the air cooling on the one hand and by the fluid cooling on the other.

Furthermore, an oil charge of this type may also be used in the case of the embodiment of FIG. 1.

I claim:

1. A motor-driven pump unit for a high-pressure cleaning apparatus, with which cleaning fluid supplied by the pump is conveyed through a casing of the motor in order to cool the motor, characterized in operation by the fact that the flow rate of cleaning fluid from said pump to the cleaning apparatus can be varied from zero flow rate to maximum flow rate while said motor continues to operate said pump and characterized in that a fan wheel driven by said motor is disposed on the side of said motor opposite said pump, said fan wheel directing a cooling air stream over said motor casing, and that said fan wheel and cooling surfaces of said motor are dimensioned such that adequate cooling of said motor is achieved by the fan air cooling alone when the flow rate of cleaning fluid from said pump to the cleaning apparatus is zero.

2. A motor-driven pump unit as set forth in claim 1 wherein said motor casing has a part thereof remote from said fan wheel and cleaning fluid is conveyed only through said part.

3. A motor-driven pump unit as set forth in claim 1, wherein said motor casing has a wall defining a duct which surrounds a stator of said motor in a helical manner in order to convey cleaning fluid through said motor casing.

4. A motor-driven pump unit as set forth in claim 3, wherein a steel tube which is embedded in said wall of said casing defines said duct.

5. A motor-driven pump unit as set forth in claim 4, wherein said wall of said casing is formed as an aluminum die-casting.

6. A motor-driven pump unit as set forth in claim 1, wherein said motor defines an interior space which is filled with oil.

* * * * *